United States Patent [19]

Bianchetta

[11] 4,023,364

[45] May 17, 1977

[54] SWING FLOW SUPPLEMENTAL TRAVEL FOR AN EXCAVATOR

[75] Inventor: Donald L. Bianchetta, Coal City, Ill.

[73] Assignee: Caterpillar Tractor Co., Peoria, Ill.

[22] Filed: July 19, 1976

[21] Appl. No.: 706,346

[52] U.S. Cl. ..... 60/421; 60/484; 60/486; 91/414; 214/138 R

[51] Int. Cl.[2] ..... F15B 13/09

[58] Field of Search ..... 60/421, 429, 484, 486; 214/138 R; 91/414

[56] References Cited

UNITED STATES PATENTS

| | | | |
|---|---|---|---|
| 3,476,274 | 11/1969 | Witwer | 214/138 |
| 3,759,357 | 9/1973 | Bianchetta | 192/3 R |
| 3,922,855 | 12/1975 | Bridwell et al. | 60/421 |

*Primary Examiner*—Edgar W. Geoghegan
*Attorney, Agent, or Firm*—Phillips, Moore, Weissenberger, Lempio & Majestic

[57] ABSTRACT

Disclosed herein is a drive and swing control system for an excavator wherein the swing pump may selectively direct fluid to the drive motors of the vehicle when the swing motor of the vehicle is not in use.

7 Claims, 1 Drawing Figure

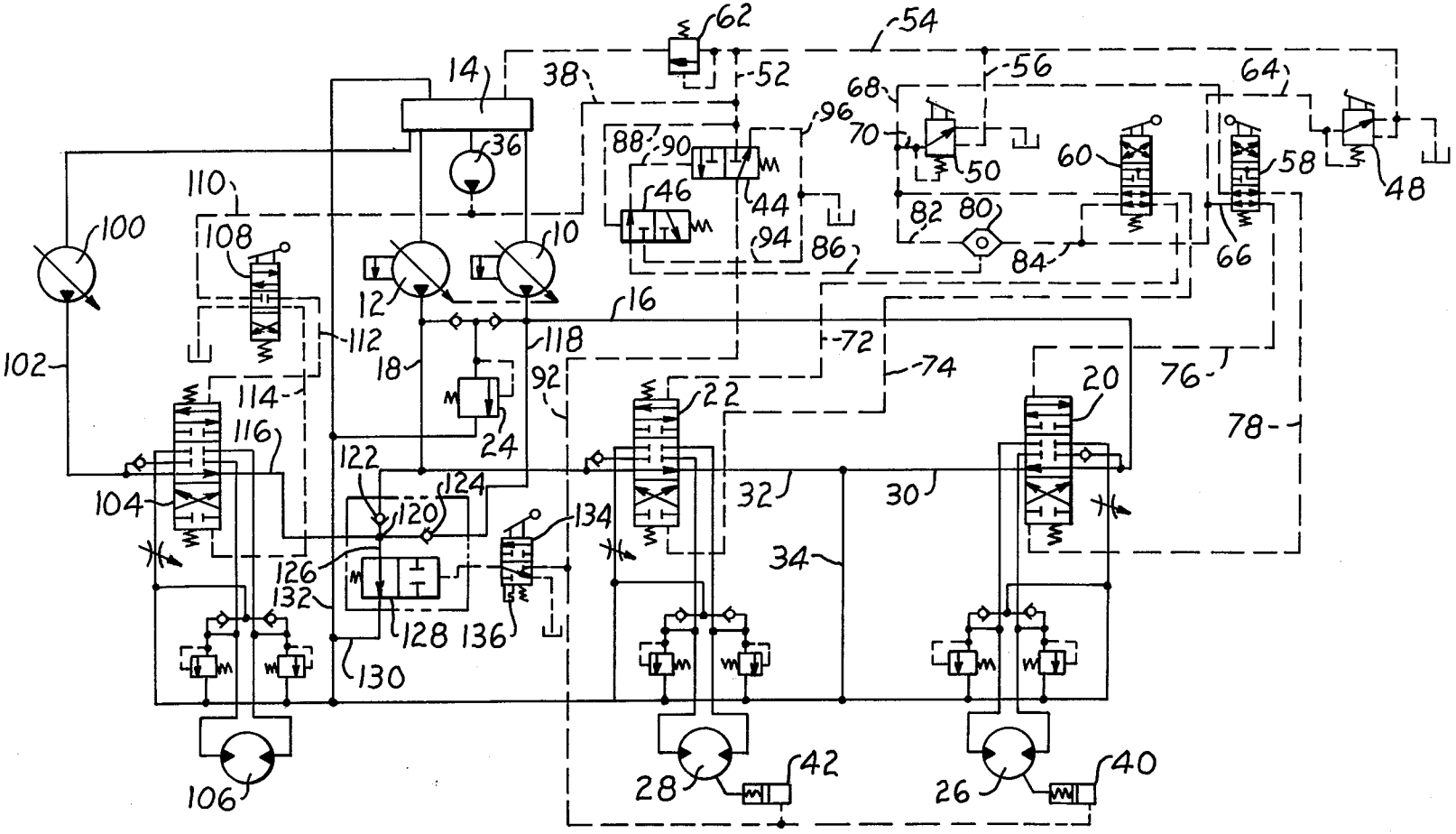
48
58
64
66
78
76
60
20
40
56
84
50
80
82
54
68
70
74
30
26
96
86
72
34
52
44
94
42
62
22
32
28
90
46
88
16
38
10
118
92
134
36
24
136
14
124
128
120
12
18
130
122
112
126
132
114
116
108
110
106
104
100
102

SWING FLOW SUPPLEMENTAL TRAVEL FOR AN EXCAVATOR

BACKGROUND OF THE INVENTION

This invention relates to control systems for a vehicle, and more particularly, to a control system for an excavator wherein hydraulically operated means are provided for swinging the machinery platform and for driving the vehicle.

In a vehicle of the type wherein a machinery platform is swung relative to the lower frame of the vehicle, it is well known to provide a hydraulic circuit for the actuation thereof. In such a typical circuit, a hydraulic pump may be selectively communicated with a hydraulic motor to drive the swing motor in one and the other directions as required, to in turn swing the machinery platform in one and the other directions. In such a system, it is generally provided that in the state wherein swinging does not take place, the swing pump communicates with tank. Thus, in such state, the swing pump is not being used. It should also be understood that in such a system the overall percentage of time that the swing pump is being used is quite small, in relation to the overall operating time of the apparatus. Such swing apparatus, for example, would not generally be used as the vehicle is driven over the ground.

Of general interest in this area is U.S. Pat. No. 3,476,274 to Witwer, disclosing a system wherein hydraulic fluid from the portion of the hydraulic system employed for swinging the machinery platform is diverted to hydraulic ram means which operate the boom or dip stick. Also of interest is U.S. Pat. No. 3,759,357 to Bianchetta (assigned to the assignee of this invention), disclosing a brake control system in conjunction with a drive control system of a vehicle. The present inventive fluid circuit incorporates the system of U.S. Pat. No. 3,759,357, which will be described in detail.

SUMMARY OF THE INVENTION

It is accordingly an object of this invention to provide a control system for a vehicle which includes a swinging machinery platform, wherein fluid from the swing pump associated with such platform may be selectively diverted to drive motors of the vehicle.

It is a further object of this invention to provide apparatus which, while fulfilling the above object, is extremely simple in design and effective in use.

Broadly stated, the apparatus comprises an actuating system for a vehicle comprising vehicle fluid drive motor means, a fluid swing motor, and fluid pump means. Means operatively connect the fluid pump means and fluid drive motor means for selectively providing communication between the fluid pump means and fluid drive motor means, and for selectively blocking communication between the fluid pump means and fluid drive motor means, to selectively place the fluid drive motor means in a driving or a non-driving state. Further included is a fluid swing pump. Means operatively connect the fluid swing pump and fluid swing motor for selectively providing communication between the fluid swing pump and fluid swing motor, and for selectively blocking communication between the fluid swing pump and fluid swing motor, to selectively place the fluid swing motor in a driving or a non-driving state. Means are included for providing that, only with communication between fluid swing pump and fluid swing motor being blocked by the means opertively connecting the fluid swing pump and fluid swing motor, fluid from the fluid swing pump may be selectively directed to drive motor means.

BRIEF DESCRIPTION OF THE DRAWINGS

These and other objects of the invention will become apparent from a study of the following specification and drawing which schematically illustrates a control system incorporating a preferred embodiment of the present invention.

DESCRIPTION OF THE PREFERRED EMBODIMENT

Referring now to the drawing the circuit of the present invention is shown in conjunction with a portion of the hydraulic circuit for a machine such as an excavator that is specifically adapted to employ the subject invention. The illustrated circuit is the propulsion control and swing circuit wherein hydraulic motors are used to drive ground-engaging translation elements such as wheels or tracks to propel the vehicle, and wherein a hydraulic motor is used to provide swinging of the machinery platform of the excavator. A pilot circuit is used to actuate control valves for the circuit. A brake releasing circuit is incorporated in the pilot circuit to automatically release the vehicle brakes upon activation of the drive circuit if the pilot control pressure is adequate for a complete release.

Initially describing the drive portion of the circuit, pumps 10, 12 draw fluid from a reservoir 14 and supply the fluid under pressure for powering the elements of the machine by way of lines 16, 18 to the respective distributor valves 20, 22. A relief valve 24 controls the maximum pressure in the main circuit. The pump 10 is the source of fluid for powering track-driving motor 26, with distributor valve 20 operative to direct fluid thereto. Distributor valve 22 is provided for controlling the operation of track-driving motor 28 with fluid supplied by the pump 12. Fluid, after flowing through the centered valves 20, 22 without diversion for operation of the motors 26, 28, passes through conduits 30, 32 to return conduit 34 for return to reservoir or tank 14, to determine a non-driving state of the motors 26, 28.

A pump 36 supplies pilot fluid by way of a line 38 to a number or pilot valves for controlling or operating the main distributor control valves 20, 22 as well as fluid for operation of the track motor brake actuating and releasing means 40, 42. The track motor brakes are controlled by means of a pressure responsive two-position, three-way brake valve 44 and a pressure responsive two-position, three-way brake saver valve 46.

The main control valves 20, 22 are pilot actuated by a pair of directional pilot valves 48, 50 which are in fluid communication with the pump 36 by means of conduits 38, 52, 54, 56 and are operative to determine the direction of rotation of the drive motors 26, 28. A pair of steering pilot control valves 58, 60 which are situated in the pilot control circuit between the directional pilot valves 48, 50 and the main control valves 20, 22 are operative to control steering of the vehicle. A relief valve 62 controls the maximum pressure in the pilot circuit.

The track drive brake actuating means 40, 42 are operatively connected to friction brakes of any suitable conventional design and are automatically spring applied and remain applied as long as the track motor control valves 20, 22 remain in neutral. However, upon pilot actuating of either one of these valves 20, 22 from neutral position when adequate pilot pressure is available, the brake saver valve 46 is automatically actuated to supply pilot fluid to breake releasing means 40, 42. Thus, the brake releasing means is normally responsive to release the brake simultaneously with actuation of a drive control valve.

In the subject arrangement, as an example, the brakes require a minimum of 250 psi to be released completely. However, the pilot system will function even ifthe supply pressure falls below 250 psi. Thus, with the vehicle travelling under these conditions, the brakes will not fully release. This results in the brakes dragging and failing prematurely. However, the subject brake saver circuit is operative to prevent this.

Upon the operator activating either of valves 48, 50, pilot pressures is directed to pilot control valves 58, 60 by way of conduits 64, 66, 68, 70. Two pairs of pilot lines 72 and 74 and 76 and 78 connect control valves 58, 60 to the main control valves 22 and 20, respectively. A three-way check or shuttle valve 80 interconnects the conduits 64, 68 by conduits 82, 84 to direct pilot pressure through a conduit 86 to the brake saver valve 46 regardless of which of the valves 58, 60 is actuated.

Pressurized fluid from pump 36 is directed by way of lines 38, 52, 88 to shift the brake saver valve 46 rightward against its spring. This permits pressurized fluid in conduit 86 from the drive and steering pilot control system portion of the circuit to be directed by conduit 90 to shift the brake valve 44 against its spring and permit pilot pressure in line 52 to be directed by conduit 92 to the brake actuating means 40, 42, for disengaging the brake. A pilot pressure of at least 260 psi in conduit 88 is required to shift the brake saver valve 46 and communicate the pilot fluid pressure to shift valve 44 to provide communication of the pilot fluid to brake actuating means 40, 42, to overcome the spring pressure and release the brake. In the event that the pilot system supply pressure drops below 260 psi, the brake saver valve 46 shifts leftward under influence of its spring and vents line 90 to tank 14 via line 94. This permits valve 44 to shift to the left (to the position shown) and connects line 92 to tank 14 by way of line 96, thus venting fluid from the releasing cylinders of the brake actuating means 26, 28.

Referring now to the swing portion of the circuit of the drawing, a pump 100 draws fluid from the reservoir 14 and supplies such fluid by way of line 102 to a distributor valve 104. The pump 100 is the source of fluid for powering the swing motor 106 with distributor valve 104 operative to direct fluid thereto. A pilot valve 108 is operatively connected with the distributor valve 104, to provide selective positioning of such distributor valve 104, by means of lines 110, 112, 114. A conduit 116, connects the valve 104 and line 18, and a line 118 also communicates the line 16 adjacent the pump 10 and the conduit 116, the conduit 116, line 18 and line 118 coming together at a common juncture 120. One-way check valves 122, 124 are included in the lines 18, 118 respectively to block any possibility of the pump pumping fluid through the conduit 116 toward the valve 104. Yet another line 126 communicates the juncture 120 and a main valve 128, and a line 130 communicates the main valve 128 with line 132 which in turn communicates with reservoir or tank 14. A two-position pilot valve 134 is operatively connected with the main valve, and includes detent means 136 for maintaining the selected position thereof, which may be chosen manually. With the pilot valve 134 in the position shown, pilot pressure is not applied to the valve 128 from the pilot system, so that open communication is provided between the juncture 120 and tank 14. Movement of the pilot valve 134 to the other position thereof applies pilot pressure to the valve 128 so that communication is blocked between the juncture 120 and tank 14.

In the operation of such system, the drive motors 26, 28 are operated in accordance with the above procedure.

Assuming, for example, that the drive motors 26, 28 of the vehicle are not being operated, the distributor valve 104 may be shifted by appropriate use of the pilot valve 108, whereby communication is provided between the swing pump 100 and swing motor 106 for operating the swing motor 106. With the swing motor 106 being operated, fluid communication between the swing pump 100 and the juncture 120 is blocked, as will be seen. If the swing motor 106 is not to be operated, fluid pressure from the pump 100 is relieved through the line 116, through the main valve 128 and to tank 14, the main valve 128 being normally positioned as shown due to the selective positioning of the two-position pilot valve 134. Thus, the fluid swing motor 106 may selectively be placed in a driving or a non-driving state.

Assuming that the drive motors 26, 28 are being operated in accordance with the above description, but with the two-positioning of the distributor valve 104 as shown, resulting in non-driving of the swing motor 106, still provides that fluid pressure from the swing pump 100 is released through main valve 128 to tank 14. Again, normal swing operation of the swing motor 106 will occur upon appropriate actuation of the pilot valve 108. If it is desired that swing pump fluid be directed to the drive motors 26, 28, the two-position pilot valve 134 is moved to its second, lower position to block off the juncture 120 form the tank 14. Then, with the distributor valve 104 in the position shown, blocking communication between the swing pump 100 and swing motor 106, fluid from the pump 100 is directed through conduit 116 to juncture 120 and into line 18 and line 118 to the motors 26, 28, to increase overall vehicle travel speed.

It is to be noted that, with the main valve 128 in a blocking position, if the distributor valve 104 is shifted so that communication is provided between the swing pump 100 and swing motor 106, communication between the swing pump 100 and conduit 116 is blocked. Thus, it will be seen that the system is designed to provide that the fluid from the fluid swing pump 100 may be selectively directed to the drive motors 26, 28 only with communication between the swing pump 100 and swing motor 106 being blocked by the distributor valve 104. As soon as the valve 104 is shifted in order to provide operation of the swing motor 106, such swing motor 106 will indeed operate, and fluid from the swing pump 100 is no longer directed to the motors 26, 28. Thus, an override feature is provided in association with the swing pump 100 and motor 106, it being assured that operation of the pilot valve 108 will achieve proper operation of the swing motor 106 as desired.

With the system in the state wherein the two-position pilot valve 134 is in its second, lower position, and with the distributor valve 104 in the position shown, the valve 128 is in a blocking position, and the pump 100 is in condition to supply fluid to the motors 26, 28 as described above. With pressure in conduit 92 directed to the brake actuating means 40, 42 for disengaging the brakes of the vehicle, shifting of the valve 44 (through operator actuation of the brakes) provides that conduit 92 is vented to tank, so that pilot pressure through pilot valve 134 to main valve 128 drops, to allow main valve 128 to shift to its open position as shown in the drawing. With main valve 128 so positioned, pump 100 is released to tank, there being no need or desire to have such pump 100 continue to supply fluid pressure to the motors 26, 28, since the brakes of the vehicles are applied.

What is claimed is:

1. An actuating system for a vehicle comprising:

vehicle fluid drive motor means;

an additional fluid motor;

fluid pump means;

means operatively connecting the fluid pump means and fluid drive motor means for selectively providing communication between the fluid pump means and fluid drive motor means, and for selectively blocking communication between the fluid pump means and fluid drive motor means, to selectively place the fluid drive motor means in a driving or a non-driving state;

an additional fluid pump;

means operatively connecting the additional fluid pump and additional fluid motor for selectively providing communication between the additional fluid pump and additional fluid motor, and for selectively blocking communication between the additional fluid pump and additional fluid motor, to selectively place the additional fluid motor in a driving or a non-driving state; and means for providing that, only with communication between the additional fluid pump and additional fluid motor being blocked by the means operatively connecting the additional fluid pump and additional fluid motor, fluid from the additional fluid pump may be selectively directed to the drive motor means.

2. The apparatus of claim 1 and further comprising brake operating means providing brake release upon application of fluid pressure thereto and brake application upon release of fluid pressure therefrom, and means for providing that, with fluid from the additional fluid pump being directed to the drive motor means, release of fluid pressure from the brake operating means provides that fluid from the additional fluid pump is no longer directed to the drive motor means.

3. The apparatus of claim 2 wherein the means for providing that, only with communication between the additional fluid pump and additional fluid motor being blocked by the means operatively connecting the additional fluid motor and additional fluid pump, fluid from the additional fluid pump may be selectively directed to the drive motor means, comprise; main valve means movable to direct fluid between the (i) means operatively connecting the additional fluid pump and additional fluid motor and the (ii) means operatively connecting the fluid pump means and fluid drive motor means, and means comprising a pilot pressure system, and movable pilot valve means operatively coupled with the pilot pressure system and main valve means, for selectively applying pilot pressure to and releasing the pilot pressure from the main valve means to provide movement of the main valve means.

4. The apparatus of claim 3 wherein the pilot valve means comprise manually operable pilot valve means.

5. The apparatus of claim 3 and further comprising means operatively connecting the pilot pressure system with the brake operating means for providing operation thereof.

6. The apparatus of claim 5 wherein the drive motor means comprises a first fluid drive motor and a second fluid drive motor, wherein the fluid pump means comprises a first fluid pump and a second fluid pump, wherein the means operatively connecting the fluid pump means and fluid drive motor means comprise (i) first means operatively connecting the first fluid pump and first fluid drive motor for selectively providing communication between the first fluid pump and the first fluid drive motor, and for selectively blocking communication between the first fluid pump and first fluid drive motor, to selectively place the first fluid drive motor in a driving or a non-driving state, and (ii) second means operatively connecting the second fluid pump and second fluid drive motor for selectively providing communication between the second fluid pump and second fluid drive motor, for selectively blocking communication between the second fluid pump and second fluid drive motor, to selectively place the second fluid drive motor in a driving or a non-driving state.

7. The apparatus of claim 1 wherein the drive motor means comprise a first fluid drive motor and a second fluid drive motor, wherein the fluid pump means comprise a first fluid pump and a second fluid pump, wherein the means operatively connecting the fluid pump means and fluid drive motor means comprise first means operatively connecting the first fluid pump and first fluid drive motor for selectively providing communication between the first fluid pump and the first fluid drive motor, and for selectively blocking communication between the first fluid pump and first fluid drive motor, to selectively place the first fluid drive motor in a driving or a non-driving state, and (ii) means operatively connecting the second fluid pump and second fluid drive motor for selectively providing communication between the second fluid pump and second fluid drive motor, for selectively blocking communication between the second fluid pump and second fluid drive motor, to selectively place the second fluid drive motor in a driving or a non-driving state.

* * * * *